US008259970B2

(12) United States Patent
Kim

(10) Patent No.: US 8,259,970 B2
(45) Date of Patent: Sep. 4, 2012

(54) ADAPTIVE REMASTERING APPARATUS AND METHOD FOR REAR AUDIO CHANNEL

(75) Inventor: Sun-min Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 563 days.

(21) Appl. No.: 12/538,230

(22) Filed: Aug. 10, 2009

(65) Prior Publication Data

US 2010/0183155 A1 Jul. 22, 2010

(30) Foreign Application Priority Data

Jan. 16, 2009 (KR) ..... 10-2009-0003747

(51) Int. Cl.
*H04R 5/00* (2006.01)
*H04R 5/02* (2006.01)

(52) U.S. Cl. ..... 381/307; 381/27; 381/17

(58) Field of Classification Search ..... 381/1, 17–23, 381/307–310, 27
See application file for complete search history.

(56) References Cited

U.S. PATENT DOCUMENTS

| | | | | |
|---|---|---|---|---|
| 4,815,133 | A * | 3/1989 | Hibino | 381/307 |
| 5,027,403 | A * | 6/1991 | Short et al. | 381/306 |
| 5,970,152 | A * | 10/1999 | Klayman | 381/1 |
| 6,681,018 | B1 * | 1/2004 | Asakura et al. | 381/18 |
| 6,721,425 | B1 * | 4/2004 | Aylward | 381/22 |
| 7,257,231 | B1 * | 8/2007 | Avendano et al. | 381/99 |
| 7,315,624 | B2 | 1/2008 | Avendano et al. | |
| 7,412,380 | B1 * | 8/2008 | Avendano et al. | 704/216 |
| 7,457,421 | B2 * | 11/2008 | Sakagami et al. | 381/27 |
| 7,974,425 | B2 * | 7/2011 | Fincham | 381/307 |
| 8,107,631 | B2 * | 1/2012 | Merimaa et al. | 381/1 |
| 2008/0247555 | A1 * | 10/2008 | Avendano et al. | 381/27 |

* cited by examiner

*Primary Examiner* — Xu Mei
(74) *Attorney, Agent, or Firm* — Sughrue Mion, PLLC

(57) ABSTRACT

Provided is an adaptive remastering apparatus and method for a rear channel, which emphasizes only signals of the rear channel while maintaining signals of other channels of a multi-channel audio signal. According to the adaptive remastering apparatus and method for a rear channel, virtual rear left and right channel audio signals are generated by multiplying a predetermined gain by ambient signals extracted from front left and right channel audio signals and are combined with input rear left and right channel audio signals, thereby increasing powers of signals of the rear channel.

20 Claims, 4 Drawing Sheets

ADAPTIVE REMASTERING APPARATUS AND METHOD FOR REAR AUDIO CHANNEL

CROSS-REFERENCE TO RELATED PATENT APPLICATION

This application claims the benefit of Korean Patent Application No. 10-2009-0003747, filed on Jan. 16, 2009, in the Korean Intellectual Property Office, the disclosure of which is incorporated herein in its entirety by reference.

BACKGROUND OF THE INVENTION

1. Field of the Invention

Apparatuses and methods consistent with the present invention relate to audio signal processing, and more particularly, to a remastering apparatus and method which reconstructs a multichannel audio signal.

2. Description of the Related Art

Surround sound refers to the reproduction of a multi-channel audio signal through a plurality of speakers to provide acoustic stereo effects to listeners. Generally, a 5.1-channel sound system includes two front left and right speakers, a center speaker, two rear left and right speakers, and a woofer. A 7.1-channel sound system further includes two left and right speakers in addition to the components of the 5.1-channel sound system. Most signals of a multi-channel audio signal tend to be concentrated in the front and center, and the multi-channel audio signal is not mastered in such a way that there are many signals in the rear. That is, an audio signal level in a rear channel is likely to be low. In this case, a listener feels that signals are concentrated in only some of a multi-channel speaker system, e.g., a 5.1-channel speaker system, that is, only the front and center speakers and sound is not reproduced well from the rear speakers, failing to experience satisfactory stereo effects. In other words, since sound is scarcely output from the rear speakers over the entire audio signal or even if so, the volume of the output sound is very low, the listener may not be provided with satisfactory stereo effects.

SUMMARY OF THE INVENTION

Exemplary embodiments of the present invention provide an adaptive remastering apparatus and method for a rear channel, in which signals of the rear channel, which are more deficient than signals of a front channel, are generated or amplified from the signals of the front channel such that the output signals of the rear channel are emphasized.

Exemplary embodiments of the present invention also provides an adaptive remastering apparatus and method for a rear channel, in which only signals of the rear channel are emphasized while maintaining signals of other channels unlike in general remastering in which multi-channel signals are reconstructed on the whole.

According to an aspect of the present invention, there is provided an adaptive remastering apparatus for rear channel audio signals of a multi-channel audio signal, the adaptive remastering apparatus including an ambient-signal extracting unit extracting ambient signals by using front left and right channel audio signals, a gain control unit providing virtual rear left and right channel audio signals by multiplying the extracted ambient signals by a predetermined gain, and a combining unit combining input rear left and right channel audio signals with the virtual rear left and right channel audio signals, respectively.

According to another aspect of the present invention, there is provided an adaptive remastering method for rear channel audio signals of a multi-channel audio signal, the adaptive remastering method including extracting ambient signals by using front left and right channel audio signals, providing virtual rear left and right channel audio signals by multiplying the extracted ambient signals by a predetermined gain, and combining input rear left and right channel audio signals with the virtual rear left and right channel audio signals, respectively.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION OF THE INVENTION

Hereinafter, exemplary embodiments of the present invention will be described with reference to the accompanying drawings.

Figure 1:
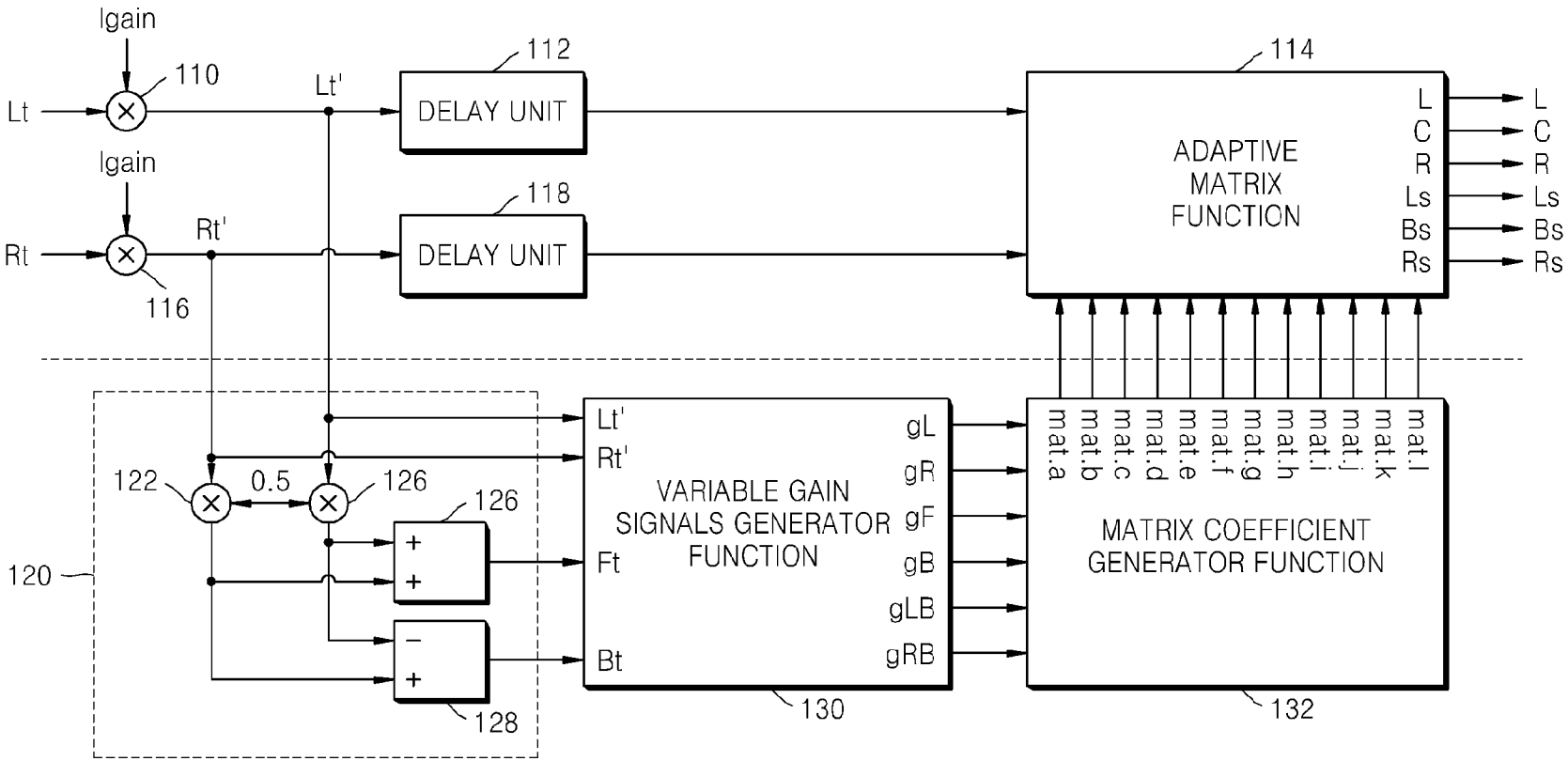
FIG. 1 (RELATED ART)
FIG. 1 is a schematic diagram illustrating a conventional multi-channel remastering apparatus.

FIG. 1 is a schematic diagram illustrating a conventional multi-channel remastering apparatus. The conventional multi-channel remastering apparatus illustrated in FIG. 1 receives two channel inputs Lt and Rt and upmix them to 5.1 channels, and in FIG. 1, a portion above a dashed horizontal line corresponds to an audio signal path and a portion below the dashed horizontal line corresponds to a control signal path.

Referring to FIG. 1, the left input signal Lt and the right input signal Rt in the front are applied to an adaptive matrix function 114 via gain functions 110 and 116 and selective delay units 112 and 118, respectively. The gain functions 110 and 116 are primarily for balancing the input signal levels and to scale the input signals Lt and Rt by −3 dB to minimize output clipping, thereby generating changed input signals Lt' and Rt'.

The output signals Lt' and Rt' of the gain functions 110 and 116 are provided to a passive matrix function 120. The Lt' and Rt' outputs are taken directly from the Lt' and Rt' inputs. In order to generate Ft and Bt, Rt' and Lt' are each scaled by 0.5 in scaling functions 122 and 124. The 0.5 scaled versions of Lt' and Rt' are summed in a combining function 126 to produce Ft and the 0.5 scaled version of Lt' is subtracted from Rt' in a combining function 128 to produce Bt. In other words, $Ft=(Lt'+Rt')/2$ and $Bt=(-Lt'+Rt')/2$). For scaling values multiplied by Lt' and Rt' in the scaling functions 122 and 124, values other than 0.5 are usable. Lt', Rt', Ft and Bt are applied to a variable gain signals generator function 130.

In response to the passive matrix signals, a variable gain signal generator function 130 generates six control signals gL, gR, gF, gB, gLB, and gRB that are, in turn, applied to a matrix coefficient generator function 132. The gL and gR control signals may be derived from a left/right (LR) error signal, the gF and gB control signals may be derived from a front/back (FB) error signal, and the gLB and gRB control signals may be derived from the LR and FB error signal.

In response to the six control signals, a matrix coefficient generator function 132 derives twelve matrix coefficients mat.a, mat.b, mat.c, mat.d, mat.e, mat.f, mat.g, mat.h, mat.i, and mat.l.

The adaptive matrix function 114 generates the output signals L (left), C (center), R (right), Ls (left surround), Bs (back surround), and Rs (right surround) in response to the input signals Lt' and Rt' and the twelve matrix coefficients from the matrix coefficient generator function 132. Various ones of the six outputs may be omitted, if desired.

The delay units 112 and 118 selectively delay input times of the signals Lt' and Rt' into the adaptive matrix function 114 to allow time for generation of the gain control signals (this is often referred to as a "look ahead).

Such a technique for receiving 2-channel inputs and upmixing them to 5.1 channels may be regarded as using a channel remastering scheme because if a 5.1-channel input is downmixed to 2 (Lt/Rt) channels and then the downmixed 2 (Lt/Rt) channels are upmixed by using the conventional multi-channel remastering apparatus shown in FIG. 1, the 2 (Lt/Rt) channels are separated into 5.1 channels. However, according the conventional technique, total channels are reconstructed, causing a problem that a signal of each channel is mixed with signals of undesired channels. That is, when only some of total channels are desired to be changed, signals of the total channels, instead of signals of desired channels, are changed.

Therefore, exemplary embodiments of the present invention provide a remastering apparatus and method which emphasizes only a signal of a specific channel, especially a signal of a rear channel, while maintaining original mastering to the maximum, unlike in conventional mastering.

More specifically, according to an exemplary embodiment of the present invention, ambient signals are extracted from front left and right channel audio signals of a multi-channel input and are added to rear channel audio signals, thereby generating new rear left and right audio signals. Although a 5.1-channel input will be described below for convenience of explanation, the spirit of the present invention is not limited to 5.1 channels and can also be applied to inputs of various multi-channels of less or more than 5.1 channels.

Generally, rear left and right channel audio signals have low signal levels or a signal having a high signal level is intermittently mastered therein, whereas front left and right channel audio signals are mostly mastered at high signal levels. Thus, ambient signals are extracted from front left and right channel audio signals and are added to original rear left and right channels, thereby generating rear channel audio signals having signal levels higher than a predetermined level. However, if the rear left and right channel audio signals originally have high signal levels, the rear channel audio signals may have excessively high signal levels when being added thereto the ambient signals extracted from the front left and right channel audio signals. For this case, it is necessary to selectively control the powers of the ambient signals to be added according to the signal levels of the original rear left and right channel audio signals. With reference to FIGS. 2 to 5, a description will be made of an adaptive remastering apparatus for a rear channel according to an exemplary embodiment of the present invention.

Figure 2:
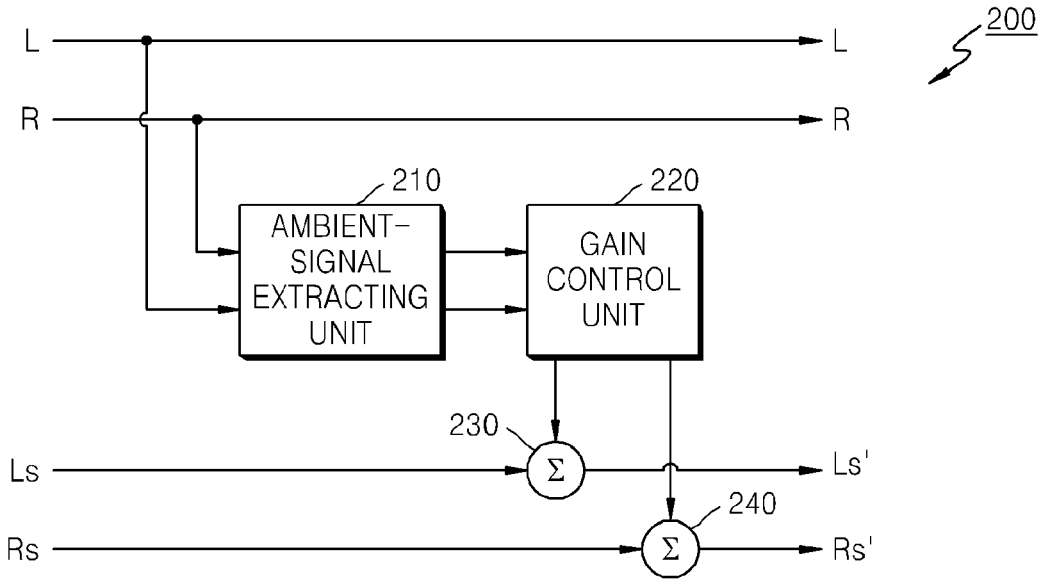
FIG. 2 is a block diagram of an adaptive remastering apparatus for a rear channel according to an exemplary embodiment of the present invention.

FIG. 2 is a block diagram of an adaptive remastering apparatus 200 for a rear channel according to an embodiment of the present invention. In FIG. 2, L represents an input front left channel audio signal, R represents an input front right channel audio signal, Ls represents an input rear left channel audio signal, and Rs represents an input rear right channel audio signal. In FIG. 2, a center channel audio signal C and a woofer signal are not shown.

Referring to FIG. 2, the adaptive remastering apparatus 200 includes an ambient-signal extracting unit 210, a gain control unit 220, a first combining unit 230, and a second combining unit 240. The input front left and right channel audio signals L and R and the center channel audio signal C of an input 5.1-channel signal are reproduced through corresponding speakers, and rear left and right channel audio signals Ls' and Rs', which are to be reproduced through rear channel speakers, are generated by combining the original input rear left and right channel audio signals Ls and Rs with virtual rear left and right channel audio signals generated from the input front left and right channel audio signals L and R as will be described below.

More specifically, the ambient-signal extracting unit 210 extracts ambient signals from the input front left and right channel audio signals L and R. A process of extracting the ambient signals will be described in detail with reference to FIG. 4. The gain control unit 220 generates the virtual rear left and right channel audio signals by multiplying the extracted ambient signals by a predetermined gain, and outputs the generated virtual rear left and right channel audio signals. Herein, the predetermined gain may be a preset value. The predetermined gain may also be set by using a result predicted from the powers of input rear channel audio signals as in an adaptive remastering apparatus for a rear channel according to an another embodiment of the present invention which will be described with reference to FIG. 3.

The first combining unit 230 outputs the final rear left channel audio signal Ls' generated by combining the input rear left channel audio signal with the virtual rear left channel audio signal which is output from the gain control unit 220, and the second combining unit 240 outputs the final rear right channel audio signal Rs' generated by combining the input rear right channel audio signal with the virtual rear right channel audio signal which is output from the gain control unit 220. The final rear left and right channel audio signals Ls' and Rs' are reproduced through rear channel speakers.

A delay unit is required in the structure illustrated in FIG. 2 for temporal synchronization for combination of signals, i.e., combination of the ambient signals extracted from the front left and right channel audio signals, with the rear left and right channel audio signals, and such a delay unit, although not shown in FIG. 2, will be recognized by those of ordinary skill in the art, as being a part of the present exemplary embodiment of the invention.

Figure 3:
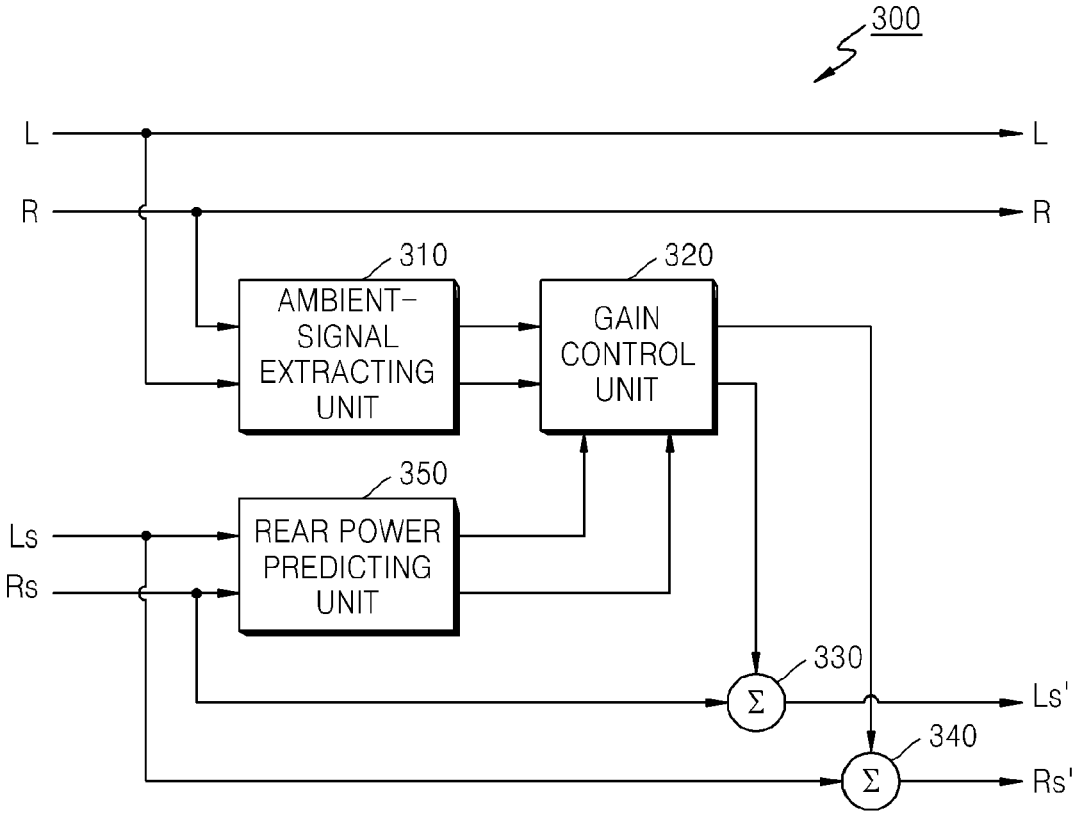
FIG. 3 is a block diagram of an adaptive remastering apparatus for a rear channel according to another exemplary embodiment of the present invention.

FIG. 3 is a block diagram of an adaptive remastering apparatus 300 for a rear channel according to another exemplary embodiment of the present invention.

Referring to FIG. 3, the adaptive remastering apparatus 300 includes an ambient-signal extracting unit 310, a gain control unit 320, a first combining unit 330, a second combining unit 340, and a rear power predicting unit 350.

Like in the previous exemplary embodiment of the present invention, the ambient-signal extracting unit 310 extracts ambient signals from the input front left and right channel audio signals L and R. The gain control unit 320 generates virtual rear left and right channel audio signals by multiplying the extracted ambient signals by a predetermined gain, and outputs the generated virtual rear left and right channel audio signals. In particular, the adaptive remastering apparatus 300 for a rear channel according to the current embodiment of the present invention may set the predetermined gain by using a result which is predicted by the rear power predicting unit 350 from the powers of the input rear channel audio signals.

More specifically, the rear power predicting unit 350 may determine the gain such that the gain is in inverse proportion to the average power of the input rear left and right channel audio signals. Herein, letting the power of the input rear left channel audio signal Ls be p1(n) and the power of the input rear right channel audio signal Rs be p2(n). Then the rear power predicting unit 350 calculates an average power (p(n)) by using p(n)=p1(n)+p2(n). The gain control unit 320 controls the gain in inverse proportional to the calculated average power. This is because, as mentioned above, if the rear channel audio signals originally have high powers, the rear channel audio signals may have excessively high powers when being added thereto the virtual rear channel audio signals extracted from the front channel audio signals L and R.

According to another exemplary embodiment of the present invention, the gain control unit 320 may control the gain by reducing the gain if the average power of the input rear left and right channel audio signals, calculated by the rear power predicting unit 350, is greater than a predetermined first threshold and increasing the gain if the calculated average power is less the first threshold. Herein, the gain control unit 320 may control the gain according to a result of comparing the average power of the input rear left and right channel audio signals with at least one threshold other than the first threshold.

Figure 5:
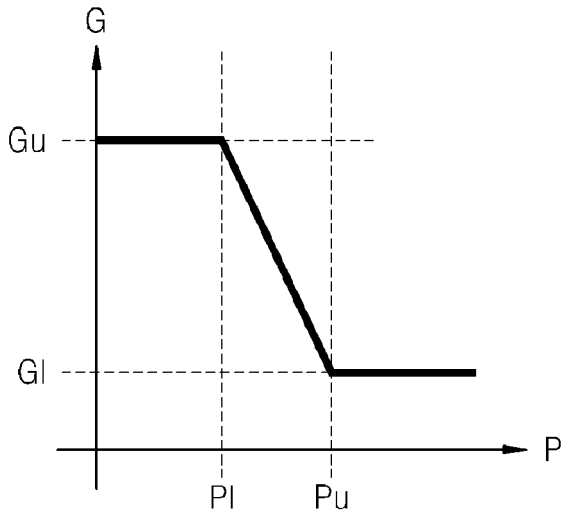
FIG. 5 is a graph for explaining an example of a gain determination process performed in a gain control unit illustrated in FIG. 3.

FIG. 5 is a graph for explaining an example of a gain determination process performed in the gain control unit 320 illustrated in FIG 3. The graph shown in FIG. 5 concerns a process performed in the gain control unit 320 to determine a gain G to be multiplied to ambient signals extracted from front channel audio signals according to a result of comparing an average power P of rear channel audio signals with two thresholds P1 and Pu.

Referring to FIG. 5, the gain control unit 320 may be set to have a gain Gu if the average power P of the rear channel audio signals is less than a first threshold P1, a gain G1 if the average power P is greater than a second threshold Pu, and a gain G which is linearly inverse-proportional to the average power P if the average power P is between the first threshold P1 and the second threshold Pu. However, the invention is not limited to FIG. 5, as the gain control unit 320 may determine the gain G which is inversely proportional to the average power P by comparing the average power P with other thresholds, and a period having a specific gain may be changed.

Referring back to FIG. 3, the first combining unit 330 outputs the final rear left channel audio signal Ls' generated by combining the input rear left channel audio signal with the virtual rear left channel audio signal which is output from the gain control unit 320, and the second combining unit 340 outputs the final rear right channel audio signal Rs' generated by combining the input rear right channel audio signal with the virtual rear right channel audio signal which is output from the gain control unit 320. The final rear left and right channel audio signals Ls' and Rs' are reproduced through rear channel speakers.

As such, in the current exemplary embodiment of the present invention shown in FIG. 3, unlike in the previous exemplary embodiment of the present invention shown in FIG. 2, a gain is controlled by using a result of predicting the power of rear channel audio signals.

Based on the foregoing exemplary embodiments of the present invention, even when there are few or no rear channel audio signals Ls and Rs, virtual rear left and right channel audio signals are extracted to be added to the original rear left and right channel audio signals, thereby providing rich rear channel sound to listeners.

Figure 4:
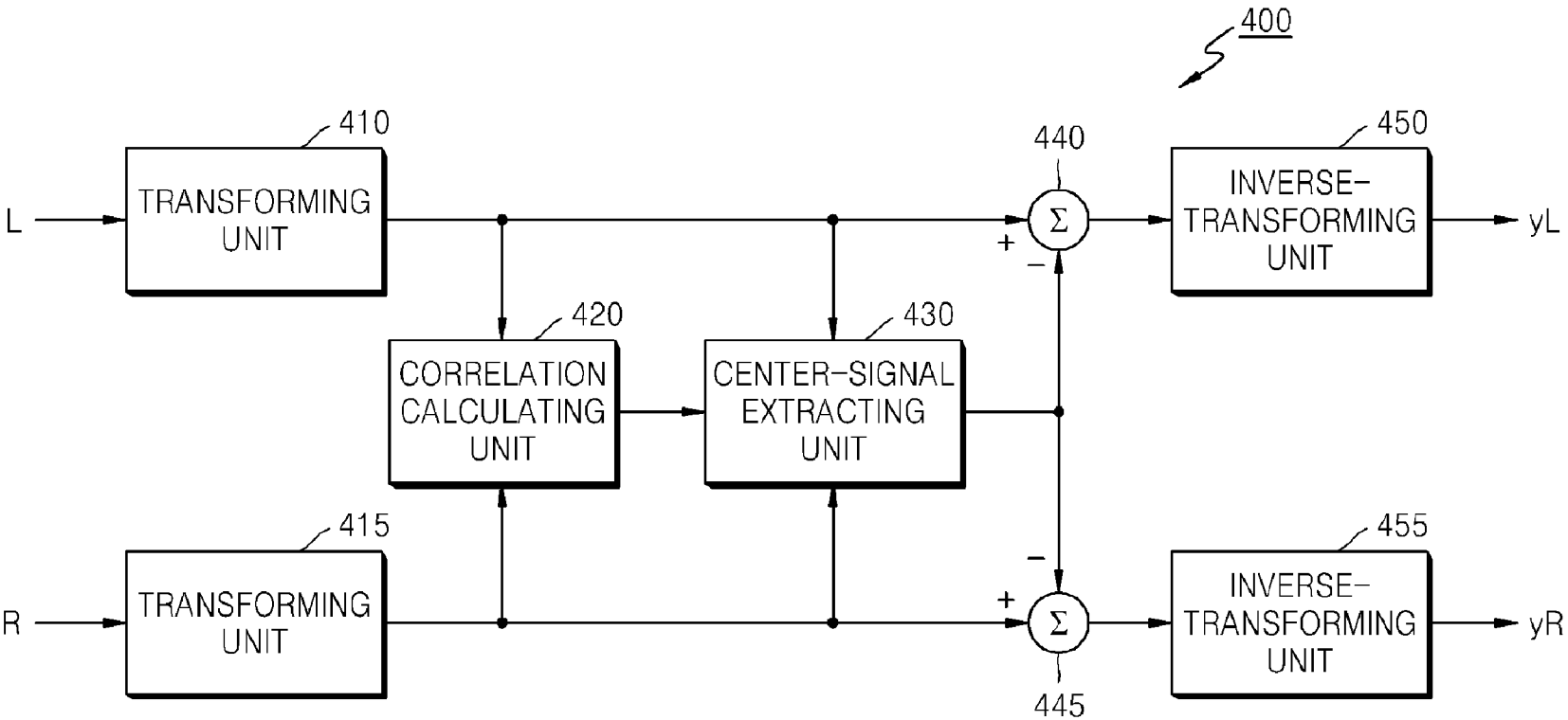
FIG. 4 is a block diagram illustrating a detailed structure of ambient-signal extracting units illustrated in FIGS. 2 and 3.

With reference to FIG. 4, a description will now be made of a process of extracting ambient signals from front left and right channel audio signals.

Generally, different components or sources are mixed between a front left channel audio signal and a front right channel audio signal, but the same mono signal like voice may be mixed in a dual mono signal both in the front left channel audio signal and the front right channel audio signal. If the dual mono signal is reproduced through rear left and right speakers, a sound image is formed in the human head and thus a listener may feel uneasy and unnatural stereo effects in comparison to when only front channel signals are reproduced. Thus, only ambient signal components having low left-right correlation may be extracted from front left and right channel audio signals and be output to a rear channel. That is, in the foregoing embodiments of the present invention, ambient signals are signals having low left-right correlation in the input front left and right channel audio signals.

FIG. 4 is a block diagram illustrating a detailed structure of the ambient-signal extracting units 210 and 310 illustrated in FIGS. 2 and 3.

Referring to FIG. 4, an ambient signal extracting unit 400 includes transforming units 410 and 415, a correlation calculating unit 420, a center-signal extracting unit 430, extracting units 440 and 445, and inverse-transforming units 450 and 455.

The transforming units 410 and 415 transform input left and right channel audio signals into a frequency domain. For example, fast Fourier transform (FFT) may be used. Let the input left channel audio signal and the input right channel audio signal, which are transformed into a frequency domain by using FFT, be X1 (n, k) and X2 (n, k), respectively. Herein, n represents a time index and k represents a frequency index. Although not shown in FIG. 4, it will be obvious to those of ordinary skill in the art that the transforming units 410 and 415 may use a critical band considering human auditory characteristics with the use of a filter bank or an equivalent rectangular bandwidth scale as well as FFT.

The correlation calculating unit 420 calculates a correlation between the input left and right audio signals L and R, which are transformed into a frequency domain. The correlation may be expressed by using one of three center indices Δ1, Δ2, and Δ3 as follows:

$$\Delta_1=\phi(n,k) \quad \text{EQN. (1)}$$

$$\Delta_2=\psi(n,k) \quad \text{EQN. (2)}$$

$$\Delta_3=\phi(n,k)\psi(n,k) \quad \text{EQN. (3)}$$

In Equations 1 and 3, ϕ(n,k) is a coherence function defined as follows:

$$\phi(n,k)=\frac{\phi_{12}(n,k)}{\sqrt{\phi_{11}(n,k)\phi_{22}(n,k)}}, \quad \text{EQN. (4)}$$

where ϕij(n,k)=(1−λ)ϕij(n−1,k)+λXi(n,k)X*j(n,k) in which λ represents a forgetting factor that is a real number between 0 and 1.

In Equations 2 and 3, ψ(n,k) is a similarity function defined as follows:

$$\psi(n,k) = \frac{2|\psi_{12}(n,k)|}{\psi_{11}(n,k)+\psi_{22}(n,k)}, \quad \text{EQN. (5)}$$

where $$\psi ij(n,k) = Xi(n,k)X*j(n,k).$$

As such, a correlation between input front left and right channel audio signals may be expressed by using one of the coherence function ϕ(n,k), the similarity function ψ(n,k), and the product thereof ϕ(n,k)ψ(n,k).

The center-signal extracting unit 430 combines the input front left and right channel audio signals with a center index for each frequency component, thereby extracting a signal of a center channel. A frequency-domain signal C(n,k) of the center channel is expressed with respect to j according to a center index used from among Δ1, Δ2, and Δ3, as follows:

$$C(n,k) = \Delta_j(n,k)(X_1(n,k)+X_2(n,k))\frac{\sqrt{2}}{2} \quad \text{EQN. (6)}$$

$$(j = 1, 2, 3)$$

The extracting units 440 and 445 subtract the extracted signal of the center channel from the original input front left and right channel audio signals for each frequency component, thereby extracting ambient signals for left and right channels. In other words, the first extracting unit 440 extracts an ambient signal A1(n,k) for the left channel by using Equation 7 and the second extracting unit 450 extracts an ambient signal A2(n,k) for the right channel by using Equation 8.

$$\Delta_1(n,k)=X_1(n,k)-C(n,k) \quad \text{EQN. (7)}$$

$$\Delta_2(n,k)=X_2(n,k)-C(n,k) \quad \text{EQN. (8)}$$

The inverse-transforming units 450 and 455 inversely transform the extracted frequency-domain ambient signals into a time domain and output a left channel ambient signal yL and a right channel ambient signal yR. If the transforming units 410 and 415 have used FFT, the inverse-transforming units 450 and 455 use inverse fast Fourier transform (IFFT).

Figure 6:
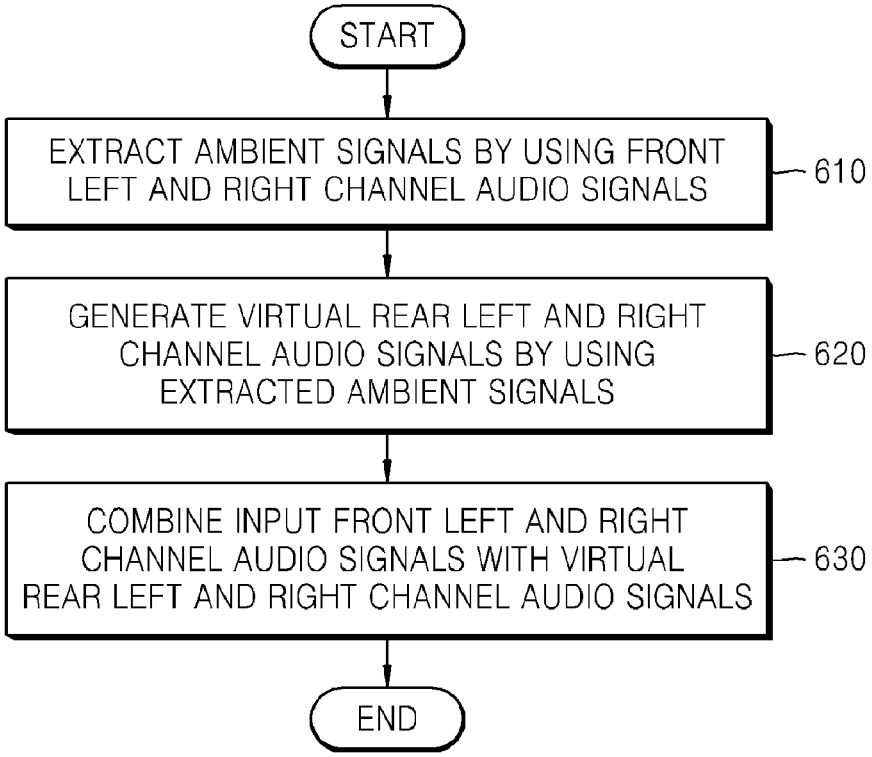
FIG. 6 is a flowchart illustrating an adaptive remastering method for a rear channel according to an exemplary embodiment of the present invention.

FIG. 6 is a flowchart illustrating an adaptive remastering method for a rear channel according to an embodiment of the present invention.

Referring to FIG. 6, in operation 610, ambient signals are extracted by using front left and right channel audio signals. As mentioned above, an ambient signal extraction process includes transforming input front left and right channel audio signals into a frequency domain, extracting a signal of a center channel for each frequency component, and subtracting the extracted signal of the center channel from an input signal of each channel to extract ambient signals.

In operation 620, the extracted ambient signals are multiplied by a predetermined gain, thereby generating virtual rear left and right channel audio signals. Herein, the gain may be a preset value or may be set inverse proportional to the average power of input front left and right channel audio signals.

In operation 630, the virtual rear left and right channel audio signals are combined with the input rear left and right channel audio signals, thereby generating final rear left and right channel audio signals.

As described above, according to exemplary embodiments of the present invention, by adaptively generating signals of a rear channel having relatively small powers among multi-channels or increasing the powers of the signals of the rear channel, listeners can be provided with excellent stereo effects.

The present invention is not limited to the above-described exemplary embodiments and various changes can be made by those of ordinary skill in the art without departing from the spirit of the present invention.

The present invention can also be embodied as can be embodied as a computer-readable code on a computer-readable recording medium. The computer-readable recording medium is any data storage device that can store data which can be thereafter read by a computer system. Examples of computer-readable recording media include read-only memory (ROM), random-access memory (RAM), CD-ROMs, magnetic tapes, floppy disks, and optical data storage devices. The computer-readable recording medium can also be distributed over network of coupled computer systems so that the computer-readable code is stored and executed in a decentralized fashion.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An adaptive remastering apparatus for rear channel audio signals of a multi-channel audio signal, the adaptive remastering apparatus comprising:

an ambient-signal extracting unit which extracts ambient signals by using a front left audio signal and a front right channel audio signal;

a gain control unit which provides a virtual rear left audio signal and a virtual rear right channel audio signal by multiplying the extracted ambient signals by a predetermined gain; and a combining unit which combines a rear left channel audio signal and a rear right channel audio signal with the virtual rear left and the virtual rear right channel audio signals, respectively.

2. The adaptive remastering apparatus of claim 1, wherein the predetermined gain is a preset value.

3. The adaptive remastering apparatus of claim 1, further comprising a rear power predicting unit which calculates an average power of the input rear left and the input rear right channel audio signals and provides a result of the calculation to the gain control unit.

4. The adaptive remastering apparatus of claim 3, wherein the gain control unit determines the predetermined gain such that the predetermined gain is in inverse proportion to the average power of the input rear left and the input rear right channel audio signals, which is calculated by the rear power predicting unit.

5. The adaptive remastering apparatus of claim 3, wherein the gain control unit controls the predetermined gain by reducing the predetermined gain if the average power of the input rear left and the input rear right channel audio signals, calculated by the rear power predicting unit, is greater than a predetermined first threshold and increasing the predetermined gain if the calculated average power is less the first threshold.

6. The adaptive remastering apparatus of claim 5, wherein the gain control unit controls the predetermined gain according to a result of comparing the average power of the input rear left and the input rear right channel audio signals with at least one threshold other than the first threshold.

7. The adaptive remastering apparatus of one of claims 1, wherein the ambient signals are signals having low left-right correlation in the input front left and the input front right channel audio signals.

8. The adaptive remastering apparatus of one of claims 1, wherein the ambient signals are obtained by subtracting a signal of a center channel from the input front left and the input front right channel audio signals.

9. The adaptive remastering apparatus of claim 8, wherein the signal of the center channel is calculated by using a correlation between the input front left and the input front right channel audio signals and the average power of the input front left and the input front right channel audio signals.

10. The adaptive remastering apparatus of claim 1, wherein the ambient-signal extracting unit transforms the input front left and the input front right channel audio signals into a frequency domain, calculates a correlation between the input front left and the input front right channel audio signals for each of frequency components, calculates a signal of a center channel by multiplying the correlation for each of frequency components by an average power of the input front left and the input front right channel audio signals, and inversely transforming values obtained by subtracting the signal of the center channel from the input front left and the input front right channel audio signals for each of frequency components, to extract the ambient signals.

11. The adaptive remastering apparatus of claim 10, wherein the correlation is expressed by one of $\phi(n,k)$, $\psi(n,k)$, and $\phi(n,k)\psi(n,k)$ which uses at least one of a coherence function and a similarity function, the coherence function being expressed by:

$$\phi(n, k) = \frac{\phi_{12}(n, k)}{\sqrt{\phi_{11}(n, k)\phi_{22}(n, k)}},$$

where $\phi ij(n,k)=(1-\lambda)\phi ij(n-1,k)+\lambda Xi(n,k)X^*j(n,k)$ in which $\lambda$ represents a forgetting factor that is a real number between 0 and 1, n represents a time index, k represents a frequency index, the input front left channel audio signal in the frequency domain is X1(n,k), and the input front right channel audio signal in the frequency domain is X2(n,k), and the similarity function being expressed by:

$$\psi(n, k) = \frac{2|\psi_{12}(n, k)|}{\psi_{11}(n, k) + \psi_{22}(n, k)},$$

where $\psi ij(n, k) = Xi(n, k)X^* j(n, k)$.

12. An adaptive remastering method for rear channel audio signals of a multi-channel audio signal, the adaptive remastering method comprising:

extracting ambient signals by using a front left channel audio signal and a front right channel audio signal;

providing a virtual rear left channel audio signal and a virtual rear right channel audio signal by multiplying the extracted ambient signals by a predetermined gain; and combining the input rear left and the input rear right channel audio signals with the virtual rear left and the virtual rear right channel audio signals, respectively.

13. The adaptive remastering method of claim 12, further comprising calculating an average power of the input rear left and the input rear right channel audio signals to predict a result of the calculating in a prediction, and controlling the predetermined gain according to a result of the prediction.

14. The adaptive remastering method of claim 13, wherein the controlling of the predetermined gain comprises determining the predetermined gain such that the predetermined gain is in inverse proportion to the average power of the input rear left and the input rear right channel audio signals.

15. The adaptive remastering method of claim 13, wherein the controlling of the predetermined gain comprises controlling the predetermined gain by reducing the predetermined gain if the average power of the input rear left and the input rear right channel audio signals is greater than a predetermined first threshold and increasing the predetermined gain if the average power is less the first threshold.

16. The adaptive remastering method of one of claims 12, wherein the ambient signals are signals having low left-right correlation in the input front left and the input front right channel audio signals.

17. The adaptive remastering method of one of claims 12, wherein the ambient signals are obtained by subtracting a signal of a center channel from the input front left and the input front right channel audio signals.

18. An adaptive remastering method comprising:

extracting a center signal from a front left channel signal and a front right channel signal;

removing the center signal from the front left channel signal to output a processed front left signal and removing the center signal from the front right channel signal to output a processed front right signal; and adaptively increasing a rear left channel signal based on a signal level of the rear left channel signal and the processed front left signal, and adaptively increasing a rear right channel signal based on a signal level of the rear right channel and the processed front right signals.

19. The adaptive remastering method of claim 18, wherein the adaptively increasing the rear left channel signal comprises increasing the processed front left signal by an adaptive gain level to output an increased front left signal, and combining the rear left channel signal and the increased front left signal, and wherein the adaptively increasing the rear right channel signal comprises increasing the processed front right signal by the adaptive gain level to output an increased front right signal, and combining the rear right channel signal and the increased front right signal.

20. The adaptive remastering method of claim 19, wherein the adaptive gain level is based on the signal level of the rear left channel signal and the signal level of the rear right channel signal.

* * * * *